United States Patent [19]

Röck et al.

[11] 4,166,307

[45] Sep. 4, 1979

[54] HINGE

[75] Inventors: Erich Röck, Höchst; Bernhard Mages, Dornbirn, both of Austria

[73] Assignee: Julius Gesellschaft m.b.H., Höchst, Austria

[21] Appl. No.: 874,684

[22] Filed: Feb. 2, 1978

[30] Foreign Application Priority Data

Feb. 11, 1977 [AT] Austria ..... 910/77

[51] Int. Cl.[2] ..... E05D 3/06

[52] U.S. Cl. ..... 16/163

[58] Field of Search ..... 16/163, 164, 191, 180, 16/183, 145, 147, 182; 99/377

[56] References Cited

U.S. PATENT DOCUMENTS

| | | | |
|---|---|---|---|
| 3,363,281 | 1/1968 | Borsani | 16/191 X |
| 3,548,445 | 12/1970 | Dehar | 16/163 X |
| 3,564,643 | 2/1971 | Salice | 16/163 |
| 3,580,607 | 5/1971 | Pletscher | 16/182 X |
| 3,864,786 | 2/1975 | Salice | 16/163 |
| 3,940,828 | 3/1976 | Lautenschlager | 16/163 |
| 4,050,116 | 9/1977 | Salice | 16/163 |
| 4,065,829 | 1/1978 | Lautenschlager | 16/163 X |

FOREIGN PATENT DOCUMENTS

| | | | |
|---|---|---|---|
| 2034013 | 12/1971 | Fed. Rep. of Germany | 16/145 |
| 2516084 | 10/1976 | Fed. Rep. of Germany | 16/163 |
| 1532667 | 6/1968 | France | 16/163 |
| 1472110 | 5/1977 | United Kingdom | 16/163 |

*Primary Examiner*—Werner H. Schroeder
*Assistant Examiner*—Moshe I. Cohen
*Attorney, Agent, or Firm*—Wenderoth, Lind & Ponack

[57] ABSTRACT

A furniture hinge includes a a hinge casing and a hinge arm which are connected by hinge links. A snapping mechanism consisting of a spring and a tipping lever are located in the hinge arm and act on a hinge link to urge the hinge into a closed position.

7 Claims, 4 Drawing Figures

HINGE

BACKGROUND OF THE INVENTION

1. Field of the Invention

The invention relates to a hinge comprising two hinge parts connected by two hinge links, two hinge axles each being disposed on each of the two hinge parts, the hinge axles substantially forming a link quadrangle with the hinge links, one spring resting on at least one hinge link, such spring producing a torque directed in the direction of the closing movement of the hinge at least in the closed position of the hinge and exerting pressure over a tipping lever which is preferably pivotally mounted on a hinge axle, the tipping lever having two pressure faces which form an angle between each other and which rest alternately on a stop of a hinge link.

2. Description of the Prior Art

Hinges having an arrangement of hinge axles and hinge links of the above-mentioned kind are widely used for furniture doors, one hinge part usually having the shape of a casing which can be inserted into a recess of the furniture door and the second hinge part being a hinge arm which can be mounted and preferably be adjusted on the side wall of the piece of furniture.

By providing such hinges with springs, a closing pressure is exerted on the door when the hinge is closed. Suggestions which have been made so far are not satisfactory, particularly because of the great strain on some parts of the hinge over an excessively long period of time. Thus, the working life of such hinges is relatively short. It is a disadvantage of many hinges that the closing pressure is exerted at any position of the door, even when the door is completely open.

With improved hinges of the above-mentioned kind the closing pressure is only exerted when the door is closed or when the door is almost closed. The door is considered as almost closed if there is an angle of approximately 10°–15° between the actual position of the door and the plane of the closed door. Thus, doors which have not carefully been closed will be closed automatically by the hinge.

SUMMARY OF THE INVENTION

It is the object of the invention to produce a spring mechanism for hinges of the above-mentioned kind which allows the use of extremely strong springs and wherein the parts belonging to the snapping mechanism are positioned in the hinge arm in such a way that they do not interfere with the other parts of the hinge arm, i.e. the adjusting screws or the like for the joint- and depth-adjustment. It has to be pointed out that particularly the means for the joint-adjustment should be positioned as close as possible to the front end of the hinge arm.

According to the invention this is achieved by positioning the tipping lever between the stop of the hinge link and the axle of such hinge link on the hinge arm and by disposing the pressure faces of the tipping lever on the side of the tipping lever which is turned away from the hinge axle.

A particularly inexpensive embodiment of the invention provides that the stop of the hinge link is shaped from the hinge link, preferably by pressure forming.

It is preferably provided that the spring acting on the tipping lever is a helical pressure spring. Particularly good results have been achieved with such a spring which is relatively strong when replacing the rather weak springs of other hinges.

A further embodiment provides that the end of the spring which is turned away from the tipping lever rests against the hinge axle of the hinge link onto which the tipping lever exerts pressure, such hinge axle being positioned on the hinge arm. This embodiment needs no further supporting member in the hinge arm for the tipping mechanism.

In order to keep the pressure spring in secure position, it is, furthermore, provided that the spring on the tipping lever is mounted in a recess of the tipping lever, such recess having the shape of a cylinder for example.

A further preferred embodiment of the invention provides that the stop of the hinge link also has two pressure faces resting on the pressure faces of the tipping lever, each pressure face of the stop corresponding to a pressure face of the tipping lever. This embodiment provides a relatively large area of contact between the individual pressure faces. Thereby the working life of such a hinge is considerably prolonged as the wear due to the inevitable friction is reduced. Moreover, the range of application of such plastic tipping levers is considerably widened. These advantages are very welcome, since a plastic tipping lever can be easily produced and has the further advantage that in the finished hinge the friction between the tipping lever and the stop on the side of the hinge link is less than the friction would be between metal and metal.

In the following an embodiment of the invention will be described in more detail with reference to the attached drawings.

DESCRIPTION OF THE PREFERRED EMBODIMENTS

Figure 3:
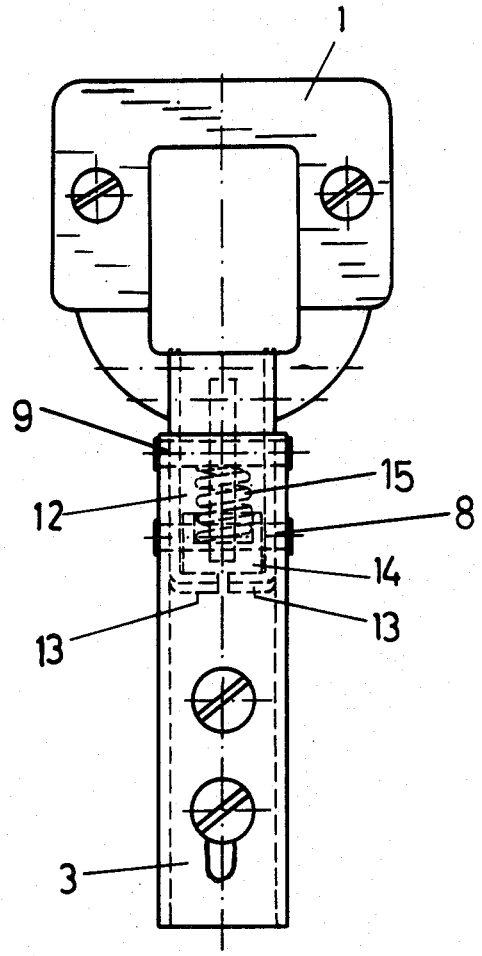
FIG. 3 shows a plan view of a hinge according to the invention in the open position.
Figure 4:
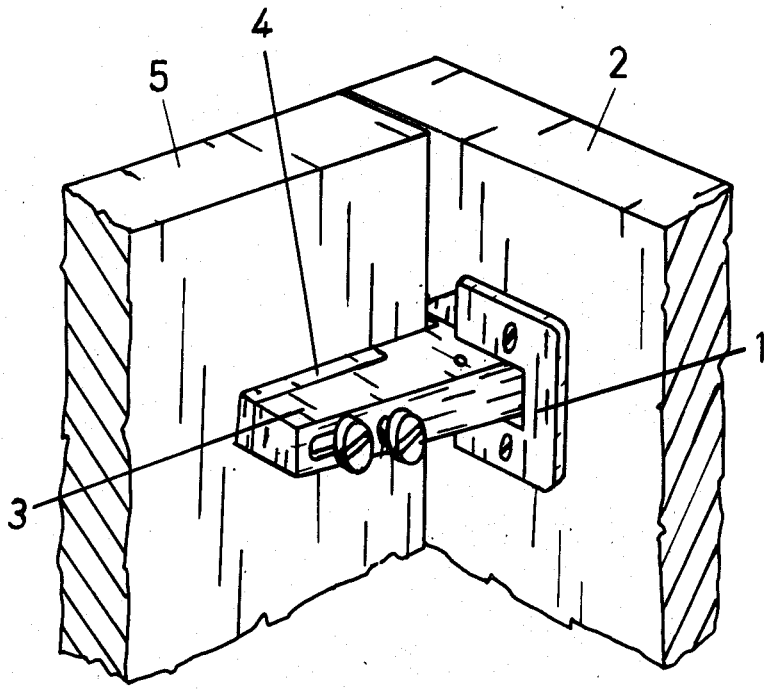
FIG. 4 shows a perspective view of a hinge according to the invention.

With the hinge according to the illustrated embodiment one hinge part is a hinge casing 1 which is to be inserted into a recess of the door 2 of the piece of furniture. The other hinge part is a hinge arm 3 which is fastened to the side wall 5 of the piece of furniture by means of a mounting plate 4. Two hinge axles 6, 7 are disposed in the casing 1 and two hinge axles 8, 9 on the hinge arm 3. The hinge axles 6, 8 are connected by means of a hinge link 10 and the hinge axles 7, 9 by means of a hinge link 11. An arm 12 is provided on the hinge link 11. The arm 12 extends the hinge link 11 beyond the hinge axle 9, and the outer end of arm 12 is bent approximately at a right angle (FIG. 3). As can particularly be seen in FIG. 3, the hinge link 11 forming the so-called outer lever is a double lever so that the hinge axle 9 and the bent portion of arm 12 forming the stop 13 for the tipping lever 14 substantially form a rectangle between each other. According to the illustrated embodiment a coil spring 15 is disposed in the hinge arm 3, one end of coil spring 15 rests against the hinge axle 9 of the hinge arm 3 and the other end is mounted on the tipping lever 14, i.e. in a cylindrical recess 16 having a centering pin 17 therein so that an optimum support of the coil spring 15 is guaranteed. The tipping lever 14 is pivotally mounted on the hinge axle 8 in the hinge arm 3.

The tipping lever 14 has two pressure faces 18, 19 on the side thereof turned away from the hinge axle 9, such faces being positioned at an obtuse angle to each other.

The stop resp. the stops 13 of the hinge link 11 also has corresponding pressure faces 20, 21. The pressure face 21 of the stop 13 rests against the pressure face 18 of the tipping lever 14 when the hinge is open, and the pressure face 20 of the stop 13 rests against the pressure face 19 of the tipping lever 14 when the hinge is closed.

Thus, the tipping lever 14 is essentially pushed under the stop 13, so that the effect of a wedge is created, thereby increasing the effect of the pressure spring 15.

Figure 1:
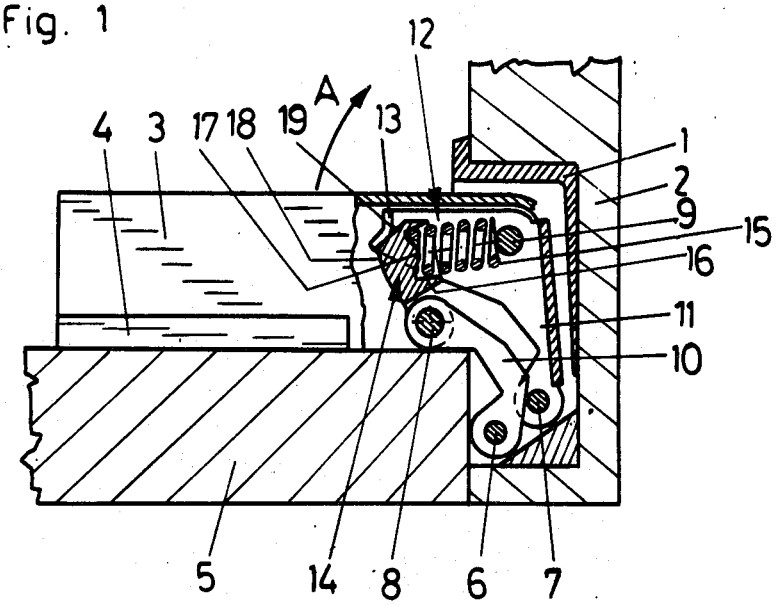
FIG. 1 shows a sectional view of a hinge according to the invention in the closed position.
Figure 2:
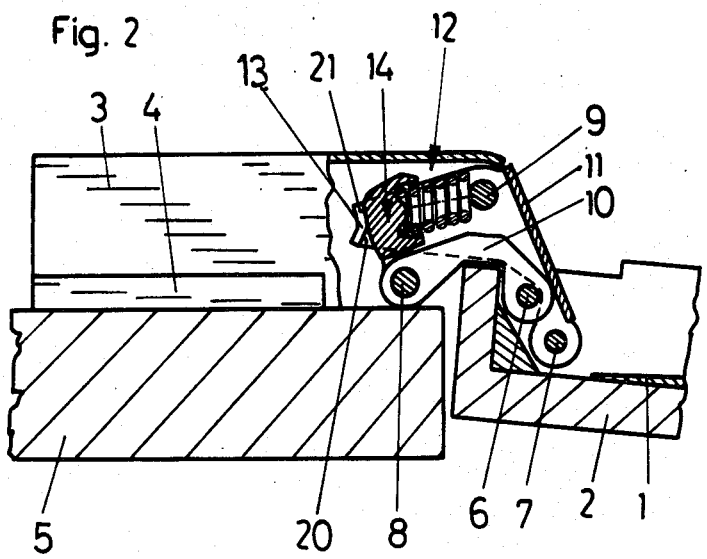
FIG. 2 shows a sectional view of a hinge according to the invention in the open position.

As can be seen in FIGS. 1 and 2 of the drawings, the force of spring 15 causes tipping lever 14 exert a torque in the direction of arrow A on the hinge link 11 when the door is completely or almost closed.

When the door 2 is open no torque is created, as can particularly be seen in FIG. 2, since the pressure face 21 of the stop 13 rests against the pressure face 18 of the tipping lever 14 and since the force exerted by the coil spring 15 acts in a straight line between face 21 and the hinge axle 9. Friction is only created between the tipping lever 14 and the stop 13 of the hinge link 11, the friction being particularly low when the tipping lever 14 is made of plastics.

FIG. 3 shows a schematic representation of the arrangement of the screws for joint- and depth-adjustments. It has to be pointed out once again that with hinges according to the invention the means for an adjustment of the joint can be disposed as close as possible to the hinge axles, i.e. as close as possible to the end of the hinge arm 3 on the side of the door.

We claim:

1. A hinge comprising:

first and second hinge parts;

a quadrangular link mechanism connecting said first and second hinge parts so that said first hinge part is movable with respect to said second hinge part between a closed hinge position and an open hinge position, said link mechanism including a first hinge link having a first end pivoted to said first hinge part by a first axle and a second end pivoted to said second hinge part by a second axle, and a second hinge link having a first end pivoted to said first hinge part by a third axle and a second end, said second hinge link being pivoted at a position between said first and second ends thereof to said second hinge part by a fourth axle, said second end of said second hinge link having a stop;

a tipping lever pivotally mounted about said second axle, said tipping lever having thereon first and second pressure faces; and spring means, having a first end abutting said fourth axle and a second end abutting said tipping lever, for urging said tipping lever into contact with said stop, such that when said first hinge part is in said closed hinge position said first pressure face is urged against said stop and creates a torque on said second hinge link, and such that when said first hinge part is in said open hinge position, said second pressure face is urged against said stop without creating a torque on said second hinge link.

2. A hinge as claimed in claim 1, wherein said stop comprises an integral bent portion of said second end of said second hinge link.

3. A hinge as claimed in claim 1, wherein said spring means comprises a helical spring.

4. A hinge as claimed in claim 1, wherein said tipping lever has therein a recess receiving said second end of said spring means.

5. A hinge as claimed in claim 1, wherein said stop has thereon first and second pressure faces contacted by said first and second pressure faces, respectively, of said tipping lever.

6. A hinge as claimed in claim 5, wherein said first pressure face of said stop and said first pressure face of said tipping lever are planar and are in mutual planar contact when said first hinge part is in said closed hinge position.

7. A hinge as claimed in claim 1, wherein said tipping lever is formed of a plastic material.

* * * * *